US008745787B1

(12) United States Patent
Heimlich

(10) Patent No.: US 8,745,787 B1
(45) Date of Patent: Jun. 10, 2014

(54) BED SHEET ANCHORING SYSTEM

(71) Applicant: Nathan Richard Heimlich, Whittier, CA (US)

(72) Inventor: Nathan Richard Heimlich, Whittier, CA (US)

( * ) Notice: Subject to any disclaimer, the term of this patent is extended or adjusted under 35 U.S.C. 154(b) by 0 days.

(21) Appl. No.: 13/859,987

(22) Filed: Apr. 10, 2013

Related U.S. Application Data

(60) Provisional application No. 61/622,344, filed on Apr. 10, 2012.

(51) Int. Cl.
*A47C 21/02* (2006.01)

(52) U.S. Cl.
USPC ..... 5/498; 5/504.1; 5/658; 5/659

(58) Field of Classification Search
CPC .... A47C 21/02; A47C 21/022; A47C 21/024; A47C 21/028
USPC ..... 5/482, 494–496, 498, 499, 504.1, 658, 5/659
See application file for complete search history.

(56) References Cited

U.S. PATENT DOCUMENTS 1,252,885 A * 1/1918 Cook ..... 24/535
2,459,497 A * 1/1949 Calabro ..... 24/72.5
4,541,137 A * 9/1985 Murray ..... 5/498
4,662,016 A * 5/1987 Seeman ..... 5/658
4,712,262 A * 12/1987 Viggiano ..... 5/658
4,716,608 A * 1/1988 Whitfield ..... 5/669
4,782,543 A * 11/1988 Hutton et al. ..... 5/658
5,014,399 A * 5/1991 Grisel ..... 24/72.5
5,033,139 A * 7/1991 Renfro ..... 5/658
5,404,602 A * 4/1995 Kondo ..... 5/504.1
5,467,491 A * 11/1995 Griffith ..... 5/658
5,555,578 A * 9/1996 Wyatt et al. ..... 5/400
6,295,670 B1 * 10/2001 Schieberl ..... 5/504.1
6,457,194 B1 * 10/2002 Bennett ..... 5/504.1
6,907,628 B2 * 6/2005 El Guermaai ..... 5/498
7,152,260 B2 * 12/2006 Ota ..... 5/504.1
7,467,428 B2 * 12/2008 Hanes ..... 5/498
7,596,822 B2 * 10/2009 Sakaldasis et al. ..... 5/658
7,698,759 B1 * 4/2010 Frasier ..... 5/504.1

* cited by examiner

*Primary Examiner* — William Kelleher
*Assistant Examiner* — David R Hare
(74) *Attorney, Agent, or Firm* — Plager Schack, LLPx

(57) ABSTRACT

A sheet anchoring system is provided to restrain the periphery of a fitted sheet on a bed, where the sheet anchoring system includes a plurality of pivotable clips each having a first end and a second end with engaging friction surfaces to grasp between the surfaces a portion of the periphery of the sheet without the need for a spring or other force-biasing mechanism. The second end also has engaging surfaces forced into engagement by the weight of the mattress on top of the second end when the second end is placed between the mattress and a box spring below the mattress.

3 Claims, 4 Drawing Sheets

BED SHEET ANCHORING SYSTEM

CROSS REFERENCE TO RELATED APPLICATIONS

This application claims priority to U.S. Provisional Patent Application 61/622,344 filed on Apr. 10, 2012 which is incorporated by reference.

FIELD OF THE INVENTION

This invention relates to devices that can hold down bed sheets.

BACKGROUND OF THE INVENTION

The problem of bed sheets being pulled from underneath a mattress is well-known. Movement on the bed causes the bed sheets to collapse toward the movement, pull the bed sheet from under the mattress.

Prior to the disclosed invention devices that held down bed sheets required elaborate systems were ineffective at keeping sheets from moving or risked injuring the user. The present invention solves this problem with a scissor clamp. The prior art includes: U.S. Pat. No. 7,698,759 issued to Frasier; U.S. Pat. No. 7,152,260 issued to Ota; and U.S. Pat. No. 4,541,137 issued to Murray.

Frasier teaches a bed sheet securing assembly comprising a scissor clamp that locks and unlocks a clamp that secures a bed sheet to a bed post. Here the scissor clamp is not directly holding the bed sheet, rather a spring clamp is. Ota teaches buckle clamp that can be used to hold down a bed sheet but does not teach a scissor clamp. Murray teaches another variety of spring clamp, but does not teach a scissor clamp.

BRIEF SUMMARY OF THE INVENTION

In one embodiment of the invention, a sheet anchoring system is provided that is configured to restrain the periphery of a fitted sheet on a bed. The sheet anchoring system may comprise, for example, a plurality of pivotable clips each having a first end and a second end, the first end comprising engaging friction surfaces configured to grasp between the surfaces a portion of the periphery of the sheet, the second end comprising engaging surfaces configured to be forced into engagement when in use by the weight of the mattress on top of the second end when the second end is placed between the mattress and a box spring below the mattress, the pivotable clips configured to securely restrain movement of the sheet periphery during use without the need for a spring or other force-biasing mechanism to maintain the friction surfaces of the first end in engagement with the sheet therebetween, the friction surfaces comprising a material having a coefficient of friction sufficient to restrain movement of the sheet from between the surfaces of the first end when in use. The first end may be configured in any number of possible shapes. For example, the first end surfaces may comprise a generally arcuate shape.

BRIEF DESCRIPTION OF THE SEVERAL VIEWS OF THE DRAWINGS

Figure 1:
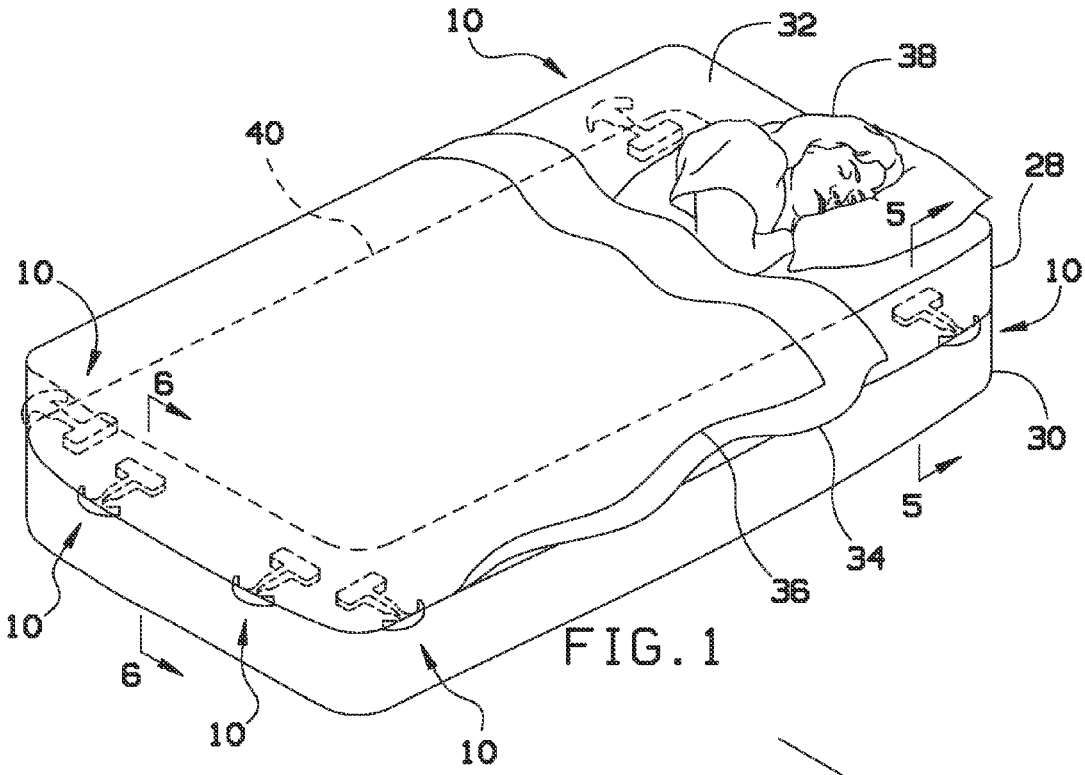

Having thus described the invention in general terms, reference will now be made to the accompanying drawings, which are not necessarily drawn to scale, and wherein:

FIG. 1 is a perspective view of an embodiment of the invention shown in use.

Figure 2:
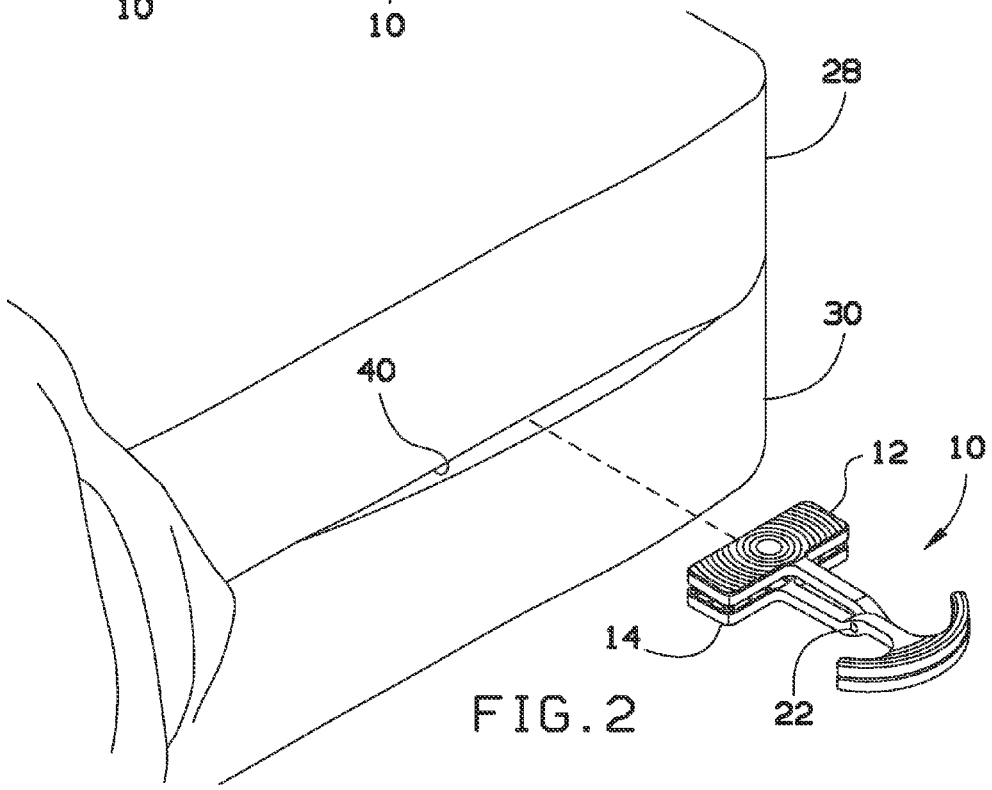

FIG. 2 is an exploded perspective view of an embodiment of the invention shown in use.

Figure 3:
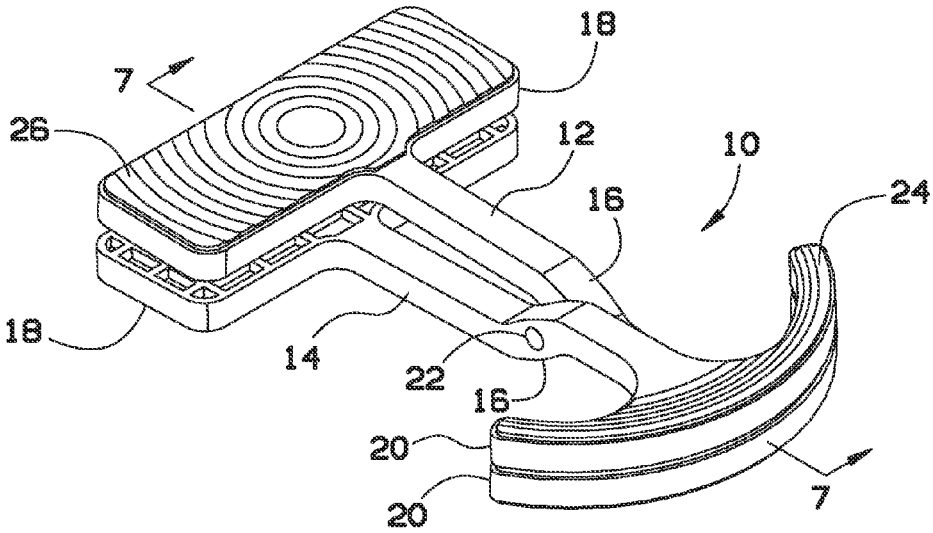

FIG. 3 is a perspective view of an embodiment of the invention.

Figure 4:
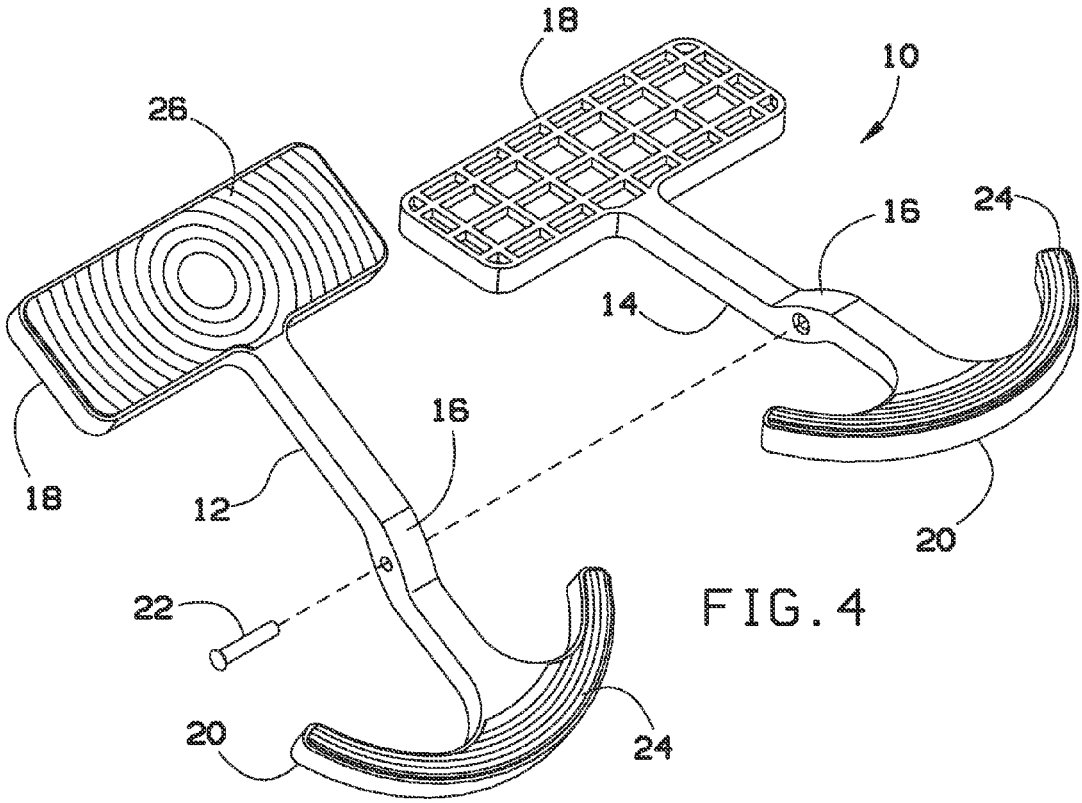

FIG. 4 is an exploded perspective view of an embodiment of the invention.

Figure 5:
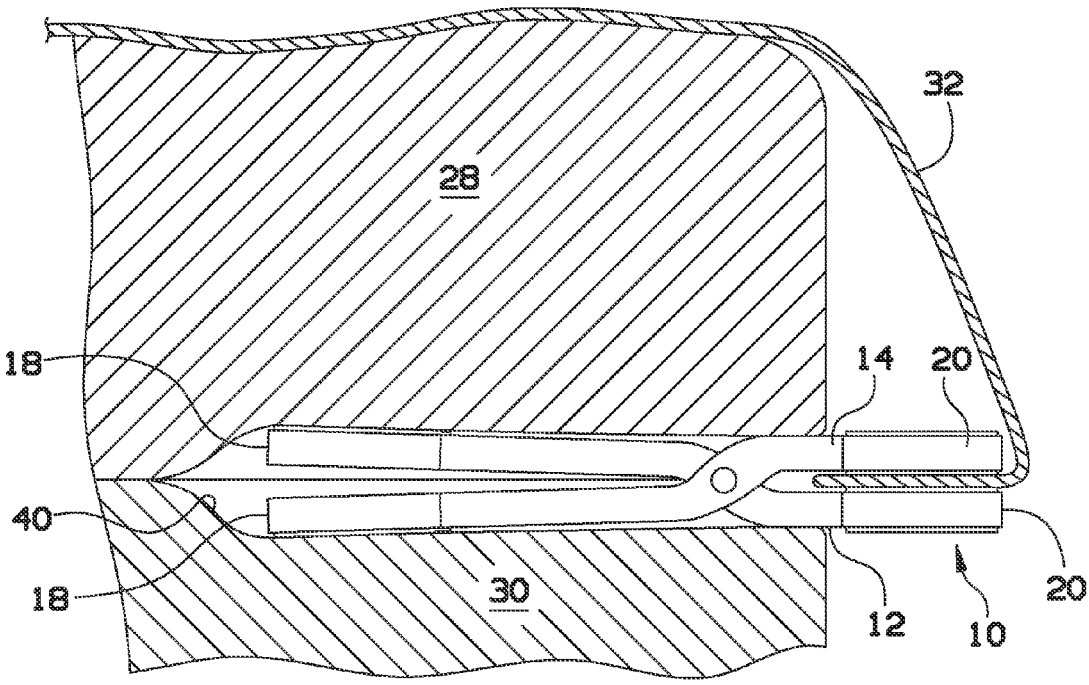

FIG. 5 is a detailed section view of an embodiment of the invention taken along line 5-5 in FIG. 1.

Figure 6:
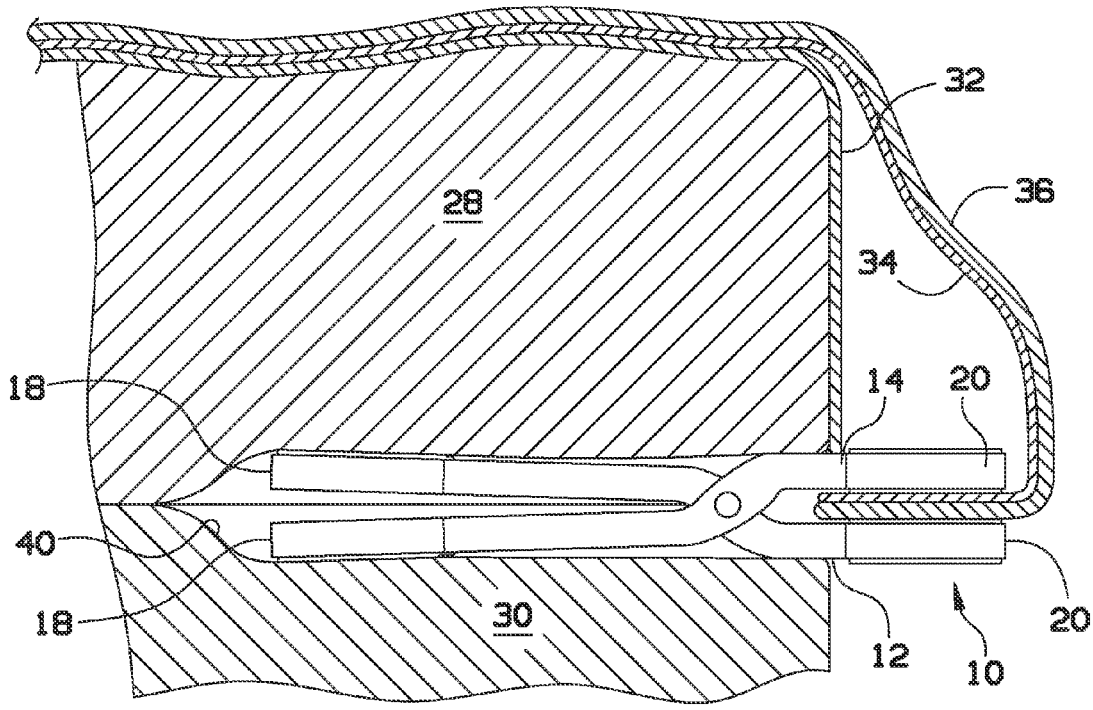

FIG. 6 is a section view of an embodiment of the invention taken along line 6-6 in FIG. 3.

Figure 7:
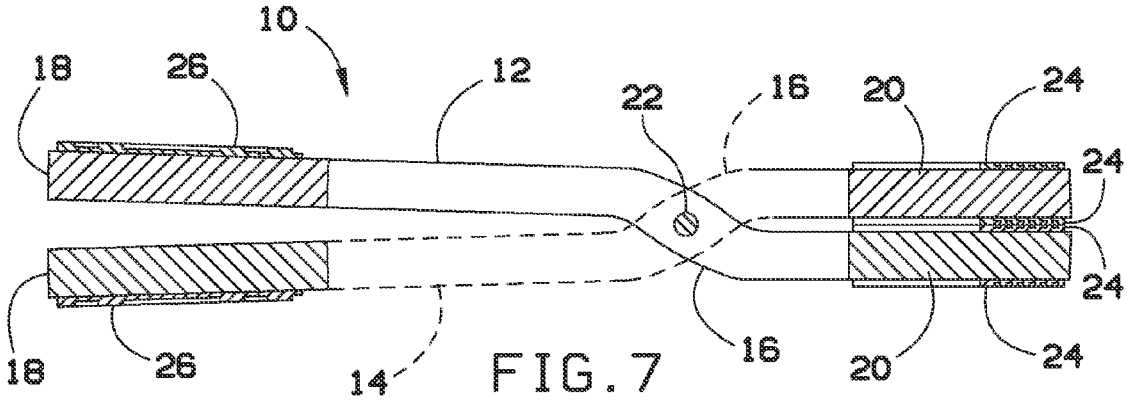

FIG. 7 is a side view of an embodiment of the invention shown in the open position.

Figure 8:
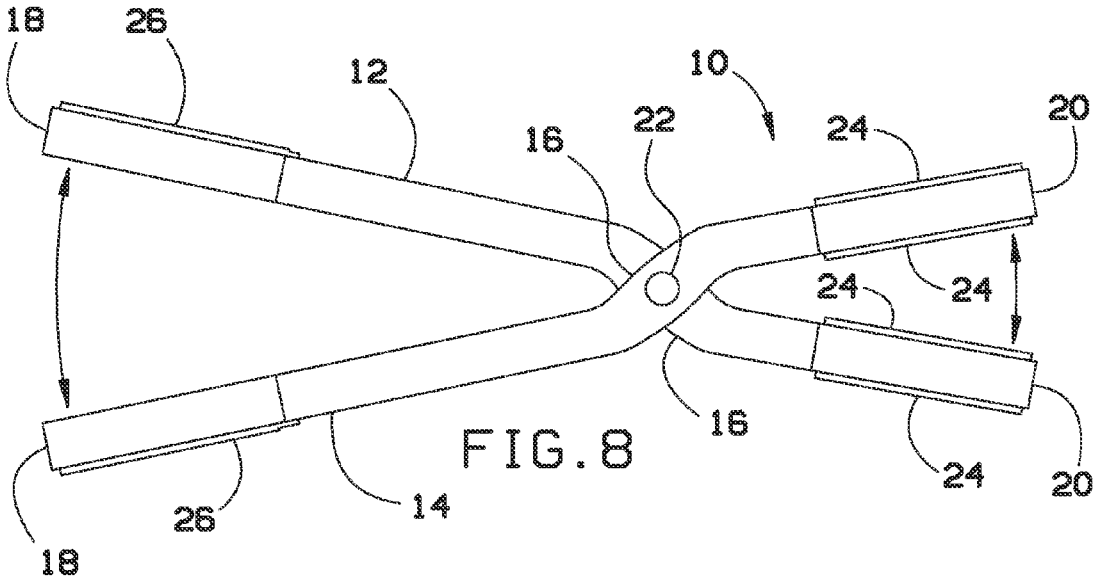

FIG. 8 is a side view of an embodiment of the invention shown in the closed position.

DETAILED DESCRIPTION OF THE INVENTION

Embodiments of the present invention overcome many of the obstacles associated with holding down bed sheets, and now will be described more fully hereinafter with reference to the accompanying drawings that show some, but not all embodiments of the claimed inventions. Indeed, the invention may be embodied in many different forms and should not be construed as limited to the embodiments set forth herein. Rather, these embodiments are provided so that this disclosure will satisfy applicable legal requirements. Like numbers refer to like elements throughout.

FIG. 1 shows sheet anchor 10 in use. User 38 sleeps on a bed that includes mattress 28 atop box spring 30. Mattress 28 is covered by fitted sheet 32. Fitted sheet 32 can be covered by flat sheet 34 and blanket 36. User 34 desires to sleep on a bed without pulling fitted sheet 32, flat sheet 34 or blanket 36 from between mattress 28 and box spring 30. Sheet anchor 10 can accomplish this.

FIG. 3 and FIG. 4 show sheet anchor 10 in more detail. Sheet anchor 10 comprises first anchor plate 12 rotationally coupled to second anchor plate 14 with rivet 22.

First anchor plate 12 comprises first flat end 18, where first flat end 18 is mechanically coupled to first flat end grip material 26. First flat end 18 is mechanically coupled to a first shank offset by first offset section 16. The remainder of the first shank is mechanically coupled to first curved end plate 20. First curved end plate 20 is mechanically coupled to first curved end plate outer grip material 24 and first curved end plate inner grip material 24. In some embodiments the curved end plates can be arcuate shaped.

Second anchor plate 14 comprises second flat end 18, where second flat end 18 is mechanically coupled to second flat end grip material 26. Second flat end 18 is mechanically coupled to a second shank offset by second offset section 16. The remainder of the second shank is mechanically coupled to first curved end plate 20. Second curved end plate 20 is mechanically coupled to second curved end plate outer grip material 24 and second curved end plate inner grip material 24.

FIG. 6 and FIG. 7 show the assembled sheet anchor in motion. As a user separates first flat end 18 from second flat end 18, first curved end plate 20 moves ultimate second curved end plate 20. In one embodiment, first offset section 16 and second offset section 16 are slightly proximate first curved end plate 20 and second curved end plate 20 while being slightly ultimate first flat end 18 and second flat end 18 respectively in order to allow for greater force and leverage to be upon sheet 32 as shown in FIG. 2, and FIG. 5. In this regard, the first end is configured at an angle from the second end.

Usage of sheet anchor 10 is shown in FIG. 2 and FIG. 5. User 38 inserts fitted sheet 32 between first curved end plate 20 and second curved end plate 20. The user then compresses first curved end plate 20 toward second curved end plate 20 such that first curved end plate inner grip material 24 and second curved end plate inner grip material 24 hold sheet 32 firmly. Next, the user slides first curved end plate 20 and second curved end plate 20 into opening 36 between mattress 28 and box spring 30 such that first flat end grip material 26 and second flat end grip material 26 create friction against mattress 28 and box spring 30 sufficient to prevent user 34 from pulling sheet anchor 10 from opening 36.

One of the useful features of sheet anchor 10 is the ability to utilize a variety of components to high coefficient of static friction ($\mu_s$) with regard to both moving sheet anchor 10 from opening 36 ($\mu_{sa}$) and moving flat sheet 32 from between first curved end plate 20 and second curved end plate 20 ($\mu_{ss}$). In particular $\mu_{sa}$ can be maximized by using a first material for first flat end grip material 26, second flat end grip material 26, first curved end plate outer grip material 24 and second curved end plate outer grip material 24 where the coefficient of static friction of the first material against the material used to make the outer surface of mattress 28 and box spring 30 is at least 0.4. Likewise, $\mu_{ss}$ can be maximized by using a second material for first curved end plate inner grip material 24 and second curved end plate inner grip material 24 where the coefficient of static friction of the second material against the material used to make flat sheet 32 is at least 0.5. The first material and the second material, do not necessarily have to be the same material, but rubber has been effective for both materials in some embodiments.

A sheet anchoring system can be made by using at least one, and in some cases more sheet anchors 10. For instance, a single sheet anchor 10 can be used at the foot of a bed. In another embodiment a first sheet anchor 10 can be placed in a first corner at the foot of a bed and a second sheet anchor 10 can be placed in a second corner at the foot of a bed. In another embodiment a first sheet anchor 10 can be placed in a first corner at the foot of a bed, a second sheet anchor 10 can be placed in a second corner at the foot of a bed, a third sheet anchor 10 can be placed in a third corner at the head of a bed and a fourth sheet anchor can be placed in a fourth corner at the head of a bed.

As shown in FIG. 1, a first sheet anchor 10 can be placed in a first corner at the foot of a bed, a second sheet anchor 10 can be placed in a second corner at the foot of a bed, a third sheet anchor 10 can be placed in a third corner at the head of a bed and a fourth sheet anchor 10 can be placed in a fourth corner at the head of a bed. Further, fitted sheet 34 and blanket 36 are held at a foot of the bed with fifth sheet anchor 10 and sixth sheet anchor 10.

In an alternative embodiment, it may be desired to maintain the periphery of the sheet in a vertical orientation along the side of the bed, rather than tucked in between the mattress and the box-spring. In such an arrangement, the first and second ends of the clips may be oriented at an angle, preferably about or about 90 degrees, but other angles may be acceptable. In such an arrangement, when the second end of the clip is placed between the mattress and the box-spring (or whatever other physical unit is supporting the mattress), the weight of the mattress on the second end of the clip forces the surfaces of the first end to tightly grasp the periphery of the sheet in a generally vertical or other non-horizontal orientation.

That which is claimed is:

1. A sheet anchoring system configured to restrain the periphery of a sheet on a bed, the sheet anchoring system comprising, a plurality of pivotable clips each having a first end and a second end, the first end comprising engaging friction surfaces configured to grasp between the surfaces a portion of the periphery of the sheet, the second end comprising engaging surfaces configured to be forced into engagement when in use by the weight of a mattress on top of the second end when the second end is placed between the mattress and a box spring below the mattress;

wherein the first end is offset from the second end such that the weight of the mattress on the second end increases a grasping force on the first end;

the pivotable clips configured to securely restrain movement of the sheet periphery during use without the need for a spring or other force-biasing mechanism to maintain the friction surfaces of the first end in engagement with the sheet therebetween, the friction surfaces comprising a material having a coefficient of friction sufficient to restrain movement of the sheet from between the surfaces of the first end when in use.

2. The sheet anchoring system of claim 1, wherein the first end surfaces comprises a generally arcuate shape.

3. The sheet anchoring system of claim 1, wherein the first end is mechanically coupled to a first shank offset by a first offset section and the second end is mechanically coupled to a second shank offset by a second offset section.

* * * * *